US007107918B2

(12) United States Patent
Caylor et al.

(10) Patent No.: US 7,107,918 B2
(45) Date of Patent: Sep. 19, 2006

(54) NEEDLE PLATE MODULES

(75) Inventors: George Leonard Caylor, Rocky Face, GA (US); Gary Ingram, Ooltewah, TN (US)

(73) Assignee: Tuftco Corporation, Chattanooga, TN (US)

( * ) Notice: Subject to any disclaimer, the term of this patent is extended or adjusted under 35 U.S.C. 154(b) by 79 days.

(21) Appl. No.: 10/948,882

(22) Filed: Sep. 24, 2004

(65) Prior Publication Data

US 2005/0257726 A1 Nov. 24, 2005

Related U.S. Application Data

(60) Provisional application No. 60/506,015, filed on Sep. 24, 2003.

(51) Int. Cl.
*D05C 15/22* (2006.01)

(52) U.S. Cl. ..... 112/80.45; 112/80.5; 112/260

(58) Field of Classification Search ..... 112/80.4, 112/80.45, 80.6, 226, 80.5, 260; 66/214, 66/116, 91

See application file for complete search history.

(56) References Cited

U.S. PATENT DOCUMENTS

| | | | | | |
|---|---|---|---|---|---|
| 3,398,708 | A | | 8/1968 | Card | |
| 3,492,956 | A | | 2/1970 | Webb | |
| 3,618,542 | A | * | 11/1971 | Zocher | 112/80.45 |
| 4,014,278 | A | * | 3/1977 | Jolley et al. | 112/226 |
| 4,061,095 | A | * | 12/1977 | Price | 112/80.6 |
| 4,384,538 | A | | 5/1983 | Slattery | |
| 4,491,078 | A | * | 1/1985 | Ingram | 112/80.6 |
| 4,503,787 | A | | 3/1985 | Watkins | |
| 4,509,439 | A | | 4/1985 | Densmore et al. | |
| 4,548,140 | A | | 10/1985 | Price et al. | |
| 4,840,133 | A | | 6/1989 | Watkins | |
| 4,841,886 | A | | 6/1989 | Watkins | |
| 5,158,028 | A | | 10/1992 | Beyer | |
| 5,295,450 | A | | 3/1994 | Neely | |
| 5,396,852 | A | | 3/1995 | Bardsley | |

* cited by examiner

*Primary Examiner*—Ismael Izaguirre
(74) *Attorney, Agent, or Firm*—Douglas T. Johnson

(57) ABSTRACT

A needle plate module is provided with fingers having a bent portion received in a lateral channel portion enabling standard screw sizes to the fingers into the module over a wide range of finger gauge spacings.

20 Claims, 9 Drawing Sheets

NEEDLE PLATE MODULES

This application claims priority to U.S. provisional patent application 60/506,015 filed Sep. 24, 2003.

FIELD OF THE INVENTION

This invention relates to needle plate modules adapted for use in tufting machines, and particularly a new type of screw lock needle plate module, suitable for use with both relatively broad and narrow gauge needle configurations.

BACKGROUND OF THE INVENTION

Tufting machines preferably operate at relatively high speed with one or more reciprocating rows of needles cooperating with loopers or hooks to form loops or bights of yarn on the reverse side of a backing material penetrated by the needle. The needles, loopers or hooks, knives, and needle plate fingers between which needles pass in their reciprocating movements, must be aligned with precision and accurately and uniformly spaced from each other so that the bills of loopers and hooks pass closely adjacent to the needles for engaging and holding yarns and the needle plate fingers do not interfere with the travel of the needles, and the knives interface with hooks to provide cutting action. When manufacturing these gauge components and the supports which carry the gauge components, any error or tolerance in positioning the components may accumulate or be repeated across the width of the tufting machine, which may be as much as four meters. In order to provide greater consistency, gauge elements have been manufactured in modular components. In many cases, modular components are cast or permanently fixed within blocks that are then mounted to specified positions along gauge bars. Examples of such modules are shown in Neely, U.S. Pat. No. 5,295,450.

In fine gauge machines, the use of modular components has become particularly widespread. So long as the mounting positions are accurately located along the gauge bar, the use of small modular sets of gauge components helps avoid accumulated error, allows for accurate and rapid location of replacement modules upon gauge element breakage, and is believed to minimize twisting of gauge elements during high speed operation.

Apart from cast modules containing gauge elements including needle plate fingers, two other general alternative modular needle plate element designs have found general acceptance. The first, as reflected in FIG. 9 of Price, et al., U.S. Pat. No. 4,548,140, utilizes screws to lock the fingers in place within a module, and would be referred to as a screw lock type needle plate module. The sizes of the screw posts and screw heads have conventionally acted as a limit upon the range of gauges of needle plate fingers that might reasonably utilized in screw lock style needle plate modules. Accordingly, these modules have been most frequently used when the gauge of a tufting machine is between about one-eighth and one-fourth gauge (between 8 and 4 yarns per inch (2.54 cm) of width). An alternative configuration utilizing a top clamping plate to hold the needle plate fingers in place is depicted in FIG. 4 of U.S. Pat. No. 4,548,140. This configuration has been adapted for use in situations in which the gauge of the tufting machine elements is to be outside the range of one-eighth to one-fourth gauge.

Thus, although the screw lock type needle plate block is desirable, until the present invention, no such construction had been developed that was deemed acceptable outside the one-eighth to one-fourth gauge range.

SUMMARY OF THE INVENTION

Consequently, it is the primary object of the present invention to provide needle plate modules for tufting machines which utilize a screw lock style mechanism for holding needle plate fingers in place and that is adaptable for use over a broad range of gauges.

It is another object of the present invention to improve the ease of manufacture of the finger components and the modular block components.

Accordingly, the present invention provides a needle plate module having a plurality of longitudinal slots to each receive a finger, and a lateral slot having apertures therein to receive locking screws and providing space for a bent section of the fingers.

BRIEF DESCRIPTION OF THE DRAWINGS

The particular features and advantages of the invention as well as other objects will become apparent from the following description taking in connection with accompanying drawings in which.

DETAILED DESCRIPTION OF THE DRAWINGS

Figure 1:
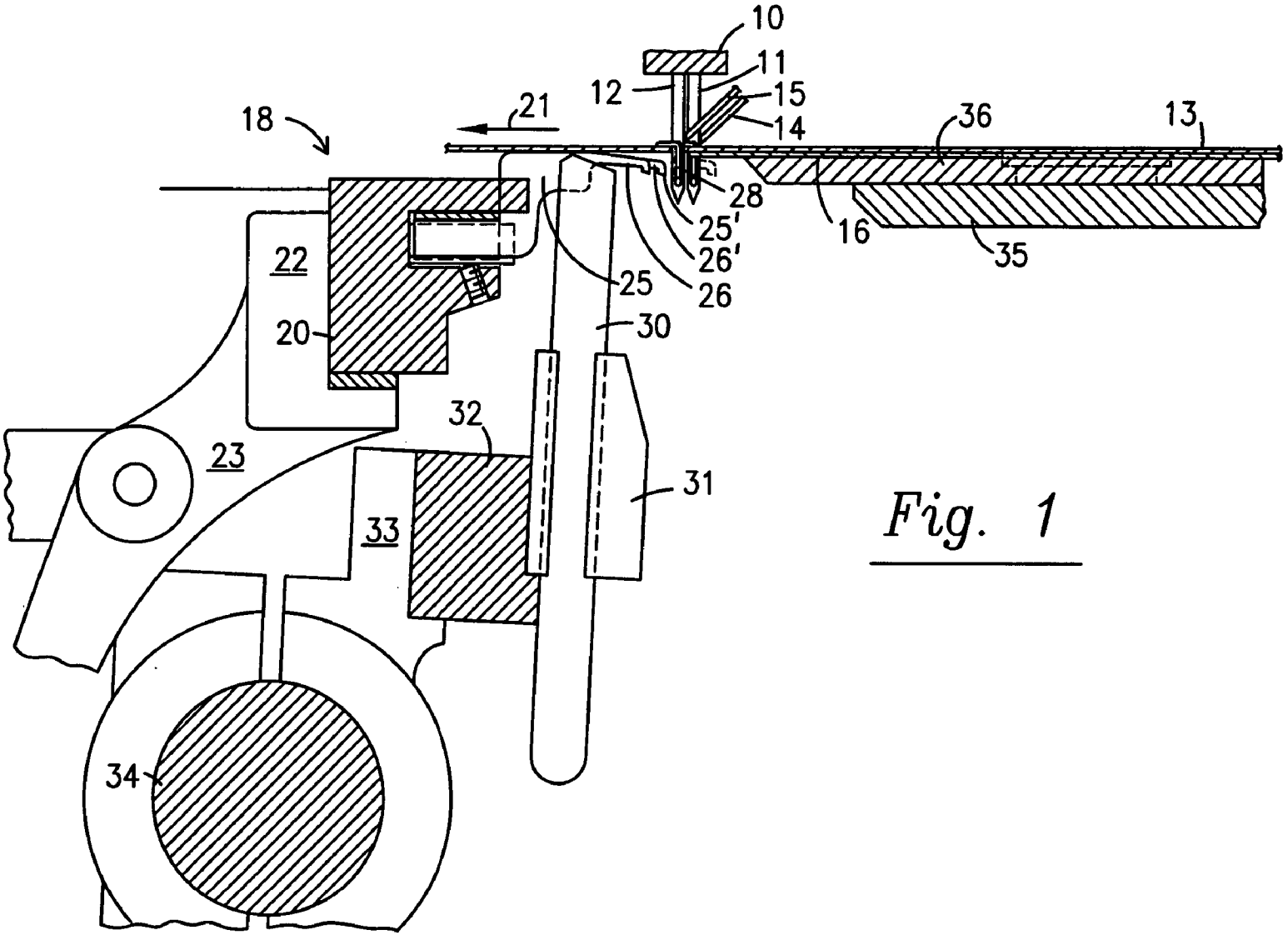
FIG. 1 is a fragmentary cross-sectional view taken through the bed of a tufting machine.

Referring now the drawings in more detail, FIG. 1 discloses a transverse needle bar 10 in a representative conventional multiple needle tufting machine supporting a first transverse row of uniformly spaced needles 11 and a second row of uniformly spaced rear needles 12 offset midway between the front needles, to provide a uniform, narrow gauge, staggered needle tufting machine. The needle bar 10 is vertically reciprocated by conventional means, not shown, to cause the front and rear needles 11 and 12 to move between an up position above the base fabric 13 to a lower position penetrating the base fabric 13, so that the needles will carry yarns 14 and 15 through the base fabric 13 to form loops of tufting therein. The base fabric 13 is supported upon the needle plate 16, made in accordance with this invention for movement, also by conventional means, in the direction of the arrow 21, that is, longitudinally from front to rear through the machine.

The looper apparatus 18 which cooperates with the needles 11 and 12 includes a transverse hook bar 20 supported upon a plurality of transversely spaced brackets 22 fixed to corresponding rocker arms journaled on a rock shaft, not shown. The rock shaft is also driven by conventional means connected to the rocker arms 23 for limited reciprocable movement in synchronism with the reciprocable movement of the needles 11 and 12.

Supported within the hook bar 20 are a plurality of transversely spaced looper hooks 25 and 25'. The structure of the alternating hooks 25 and 25' are similar, except that the bills 26' of the looper hooks 25' are slightly longer than the bills 26 of the looper hooks 25, to permit the bills 26 and 26' to cross their corresponding needles 12 and 11 by substantially the same amount in order to seize the corresponding yarns 15 and 14 to form the tufted loops 28.

A knife 30 is provided for each looper hook 25 and 25' to cooperate with the corresponding hooks 25 and 25' to produce cut pile tufts. The knives 30 are mounted in knife blocks 31 carried upon a transverse knife bar 32 which in turn is carried by the arms 33 mounted on the reciprocably driven rotary knife shaft 34. The knife shaft 34 and the means for driving the hook bar 20 and the needle bar 10 are all driven snychronously by conventional means utilizing either electronic or mechanical synchronization, to cause the needles 11 and 12, the looper hooks 25 and 25', and the knives 30, to cooperate to form cut pile tufts from the yarns 14 and 15.

The needle plate assembly comprises a plurality of needle plates or needle plate sections, arranged end to end transversely of the tufting machine. When the needle plate is of conventional manufacture, each section would typically be approximately fifteen inches in width. However, when manufactured as a needle plate module, each module would typically be only about one to two inches (2.54 to 5.08 cm) in width. The needle plate assembly 16 is mounted upon an elongated backing plate 36, adapted to be supported upon the bed plate 35 of the tufting machine. The tufting machine configuration depicted in FIG. 1 is for illustrative purposes only. Many other configurations of loopers or hooks, single or double rows of needles, and even twin needle bars could alternatively be employed with the needle plate modules described below.

Figure 2A:
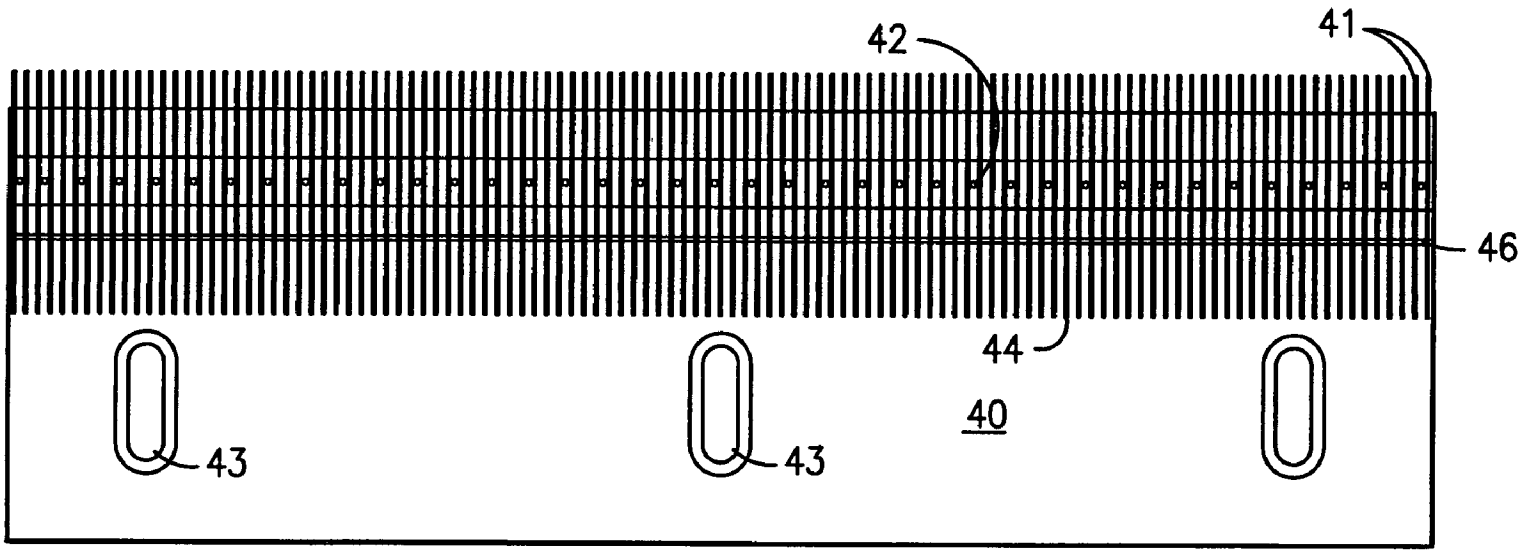
Fig. 2A PRIOR ART
FIGS. 2A and 2B are top and side plan views, respectively, of a traditional non-modular screw lock type needle plate for a tufting machine.
Figure 2B:
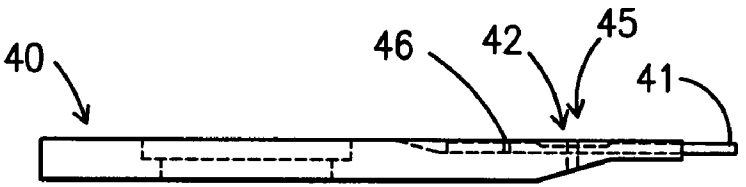
Fig. 2B PRIOR ART

FIGS. 2A and 2B illustrate prior art needle plate components 40, which have typically been between about one foot and two feet (30.48 to 60.96 cm) in width and preferably about fifteen inches (38.1 cm) wide having apertures 43 to engage upon a mounting plate (not shown) and slots 44 to receive fingers 41. Fingers 41 are uniformly notched on the portions received in slots 44 and a lateral member is engaged in slot 46 of needle plate component 40 and interfitting with notched portions of fingers 41 to prevent forward and rearward movement of fingers. A shallow channel portion 45 has threaded apertures 42 to receive screws (not shown), the heads of the screws extending sufficiently to hold adjacent fingers 41 within slots 44 when fastened. The shallow channel 45 permits top portions of fingers 41 to be exposed to clamping action from screw heads.

Figure 3A:
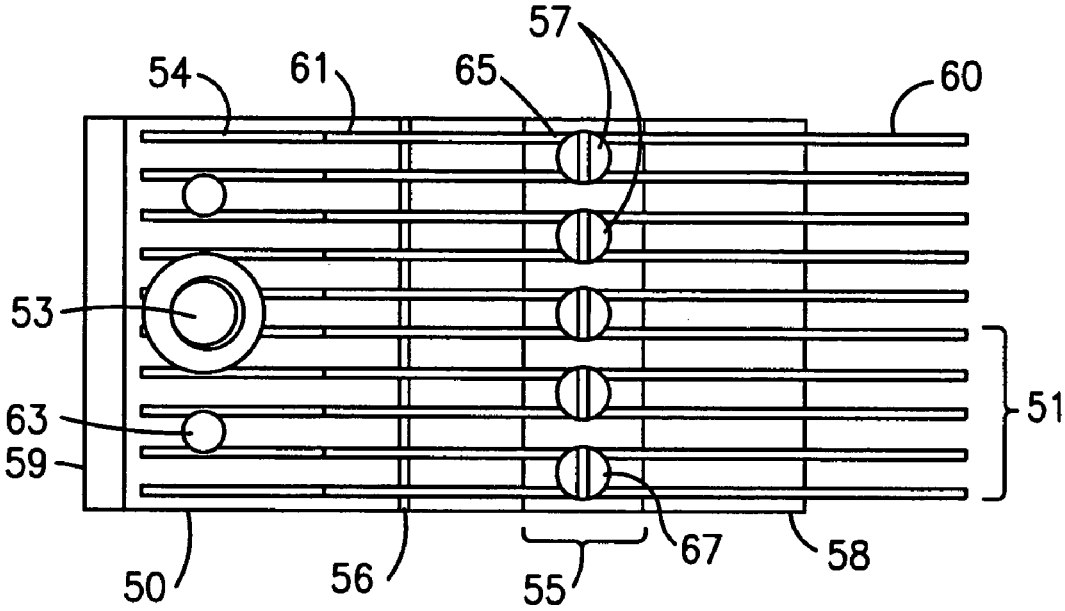
FIGS. 3A and 3B are top and side plan views, respectively, of the needle plate construction of FIG. 2 converted into a modular component.
Figure 3B:
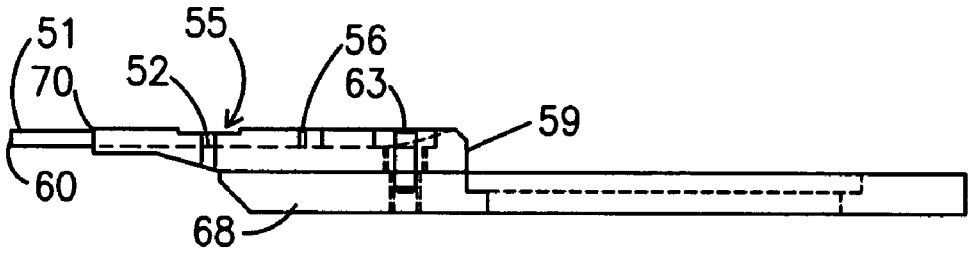

FIGS. 3A and 3B depict a modular needle plate of similar construction to the needle plate components of FIG. 2. The most noticeable distinction in the modules 50 of FIGS. 3A and 3B are their narrow width and varied fittings for mounting to the bed plate of the tufting machine. Specifically, modules 50 have proximal end 59 distal end 58 and are cut with transversely spaced longitudinal slots 54 to receive fingers 51. In addition, modules 50 have threaded aperture 53 and pin apertures 63 to facilitate the secure location and attachment of modules to the tufting machine. Modules 50 also have lateral slot 56 and shallow channel 55. Proximal ends or heads 61 of fingers 51 are received in slots 54 towards the proximal end 59 of modules 50 while distal ends or tails 60 of fingers 51 protrude past the distal end 58 of modules 50. Due to the recess of shallow channel 55, top surfaces 65 of fingers 51 are exposed to clamping action by screw heads 67 of screws 57 received in threaded apertures 52 of the modules 50. Modules 50 are securely mounted by a threaded bolt (not shown) received through threaded aperture 53 and pins 62 received through pin apertures 63 onto backing plate 68 which is in turn mounted to the bed plate of the tufting machine.

Figure 4:
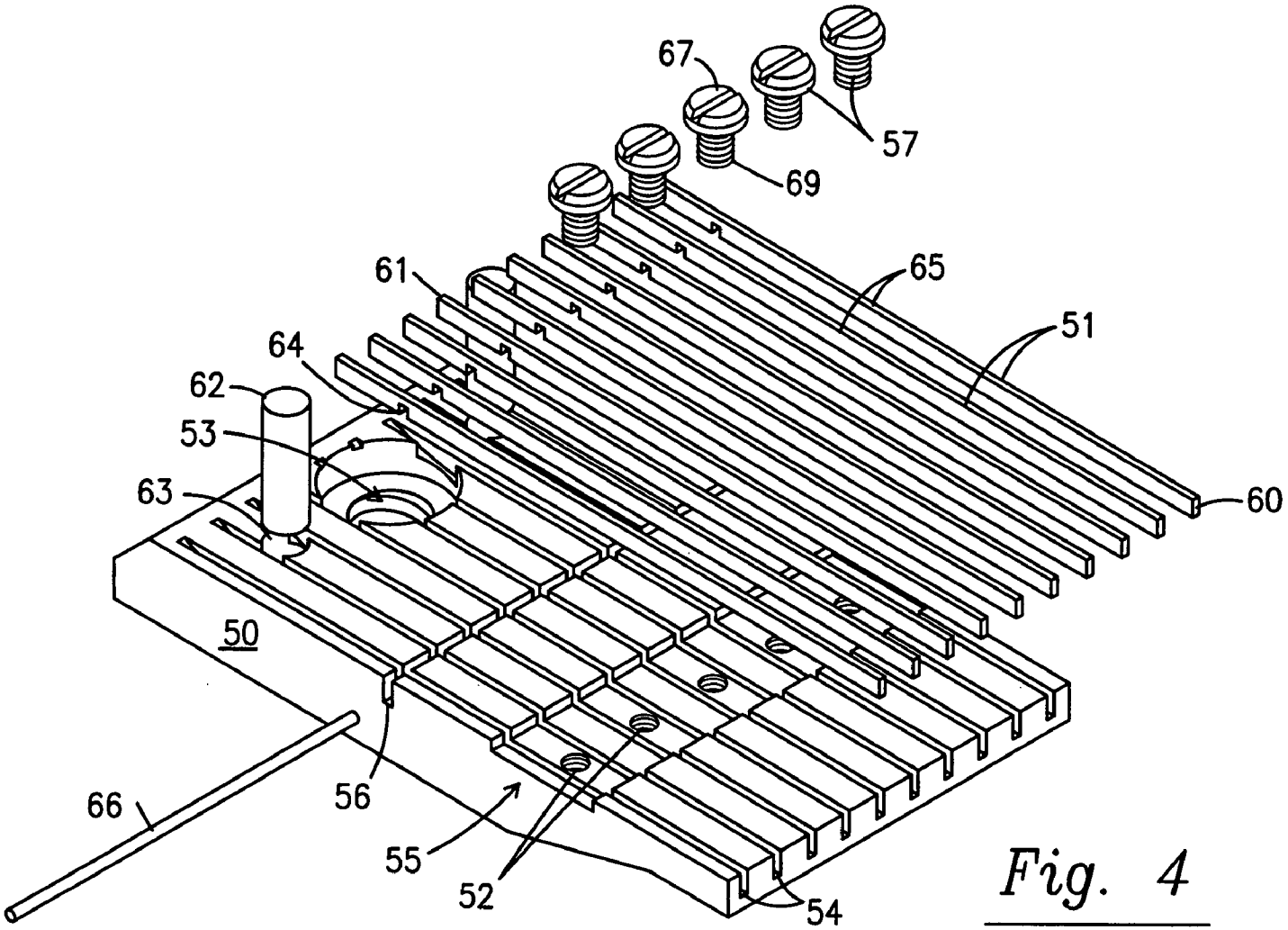
FIG. 4 is an exploded perspective view of the modular needle plate component of FIG. 3.
Figure 5:
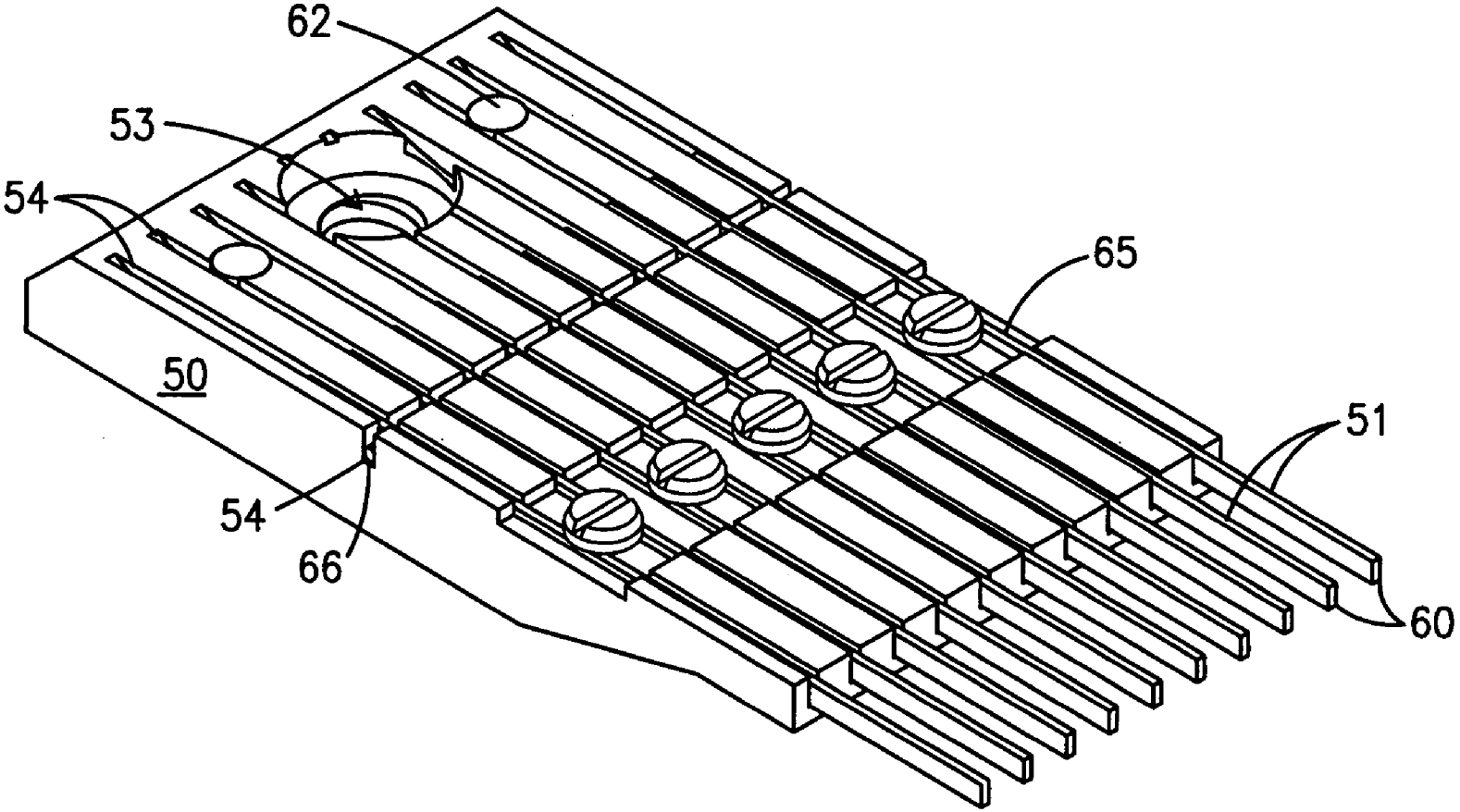
FIG. 5 is a perspective view of the assembled needle plate module of FIGS. 3 and 4.

As best seen in FIG. 4, fingers 51 have notches 64 located toward their proximal ends 61. When lateral member 66 is engaged in lateral slot 56, the lateral member 66 engages in finger notches 64 to restrict longitudinal movement of fingers 51. Threaded posts 69 of screws 57 are received in threaded apertures 52 within shallow channel 55 so that each screw head 67 clamps downward on the upper surfaces 65 of adjacent fingers 51. The downward clamping action prevents fingers 51 from rising within slots 54 to disengage notches 64 from lateral member 66. FIG. 5 illustrates an assembled module from the components illustrated in exploded fashion in FIG. 4.

In a carpet mill, the smallest screw size that has met with widespread acceptance is denominated 2-56. With reference to screws 57 as shown in FIG. 4, the numeral 2 represents the approximate 2/32 inch (0.15875 cm) diameter of the post 69 and the numeral 56 represents the threads per inch (2.54 cm) on the post 69. The diameter of the screw head 67 on a 2-56 screw is about 0.167 inches (0.42418 cm). It has not proved practicable to utilize 2-56 screws to construct needle plates with a gauge below one-eighth inch (0.3175 cm). Similarly, when larger screws 57 are utilized, the screw heads 67 become so large as to protrude upward and interfere with progress of the backing material 13 shown in FIG. 1. The height of the head 67 of an 8-32 screw is nearly 1/10 inch (0.254 cm). Accordingly, the screw lock type needle plates have not proved practicable for tufting machine gauges outside the range about one-eighth to one-fourth inches (0.3175 to 0.6350 cm).

Figure 6:
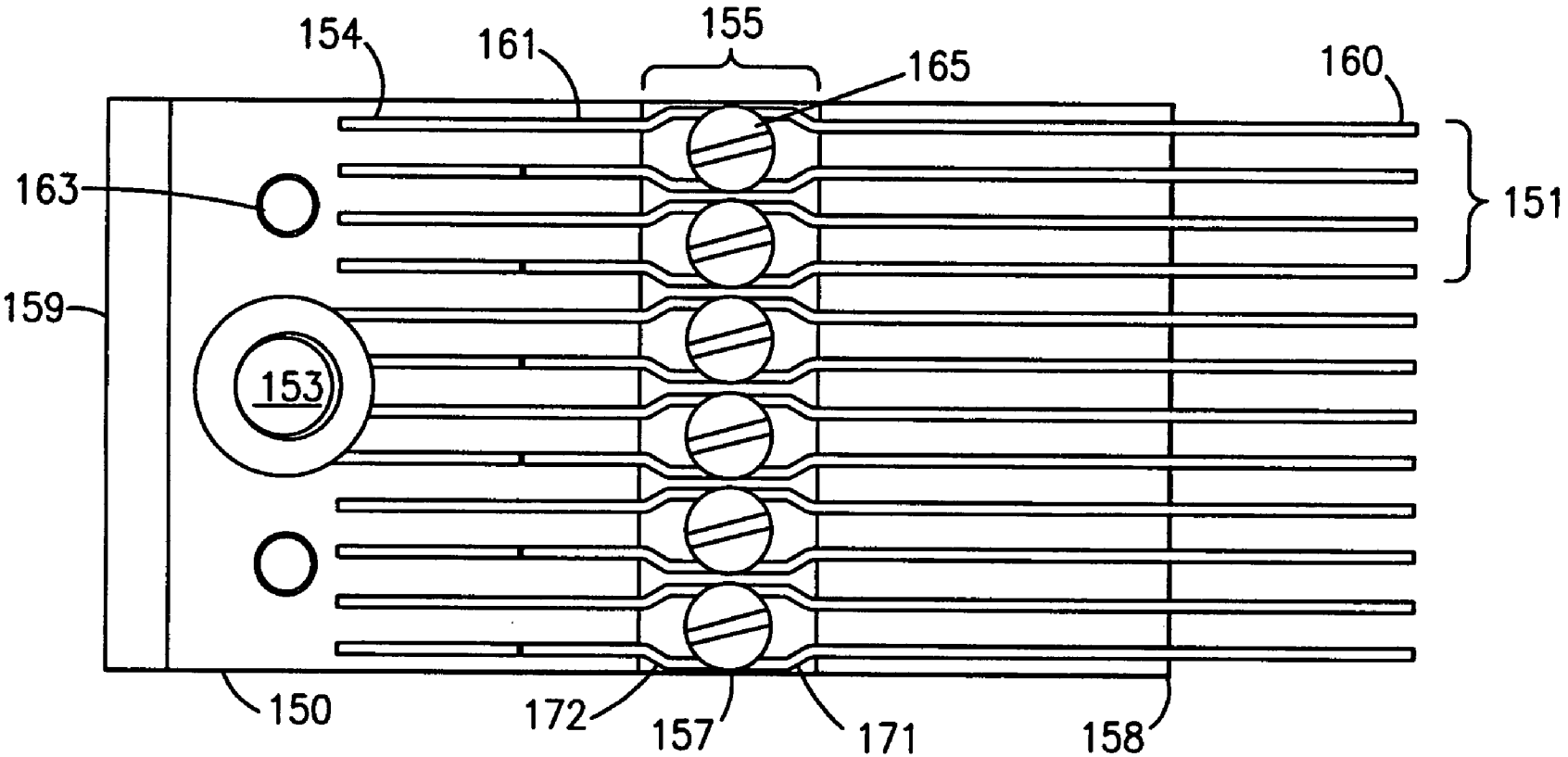
FIG. 6 is a top plan view of a needle plate module according to the present invention.
Figure 7A:
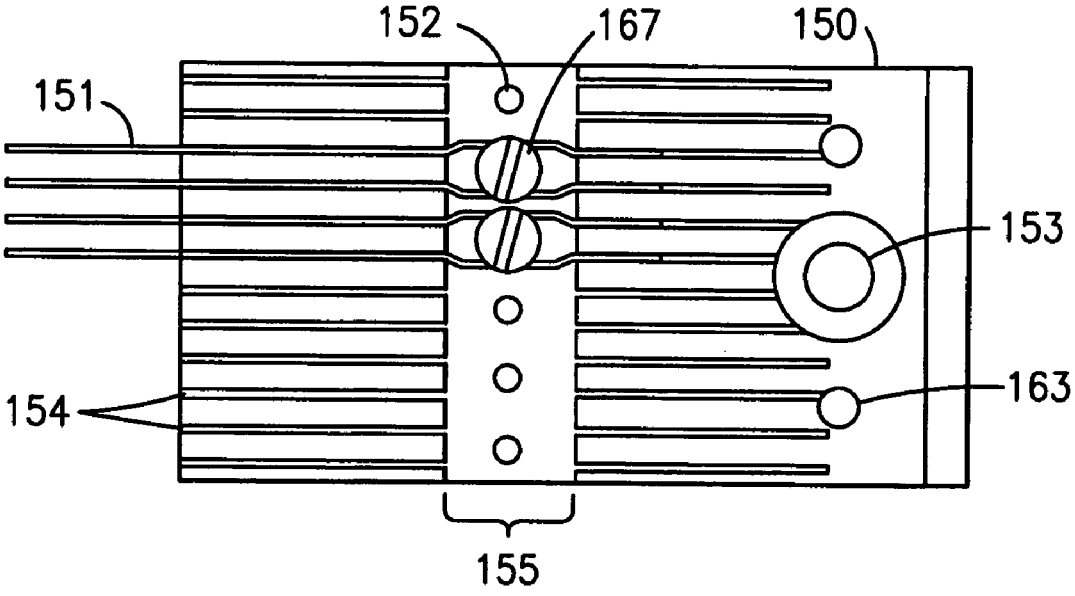
FIGS. 7A and 7B are top and side plan views of a needle plate module according to the present invention.
Figure 7B:
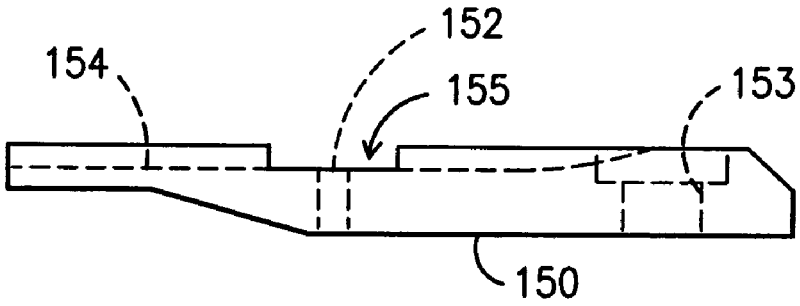
Figure 7C:
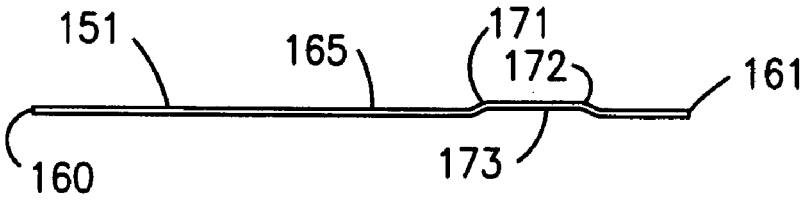
FIG. 7C is a top plan view of a needle plate finger of the present invention shown in isolation.
Figure 8:
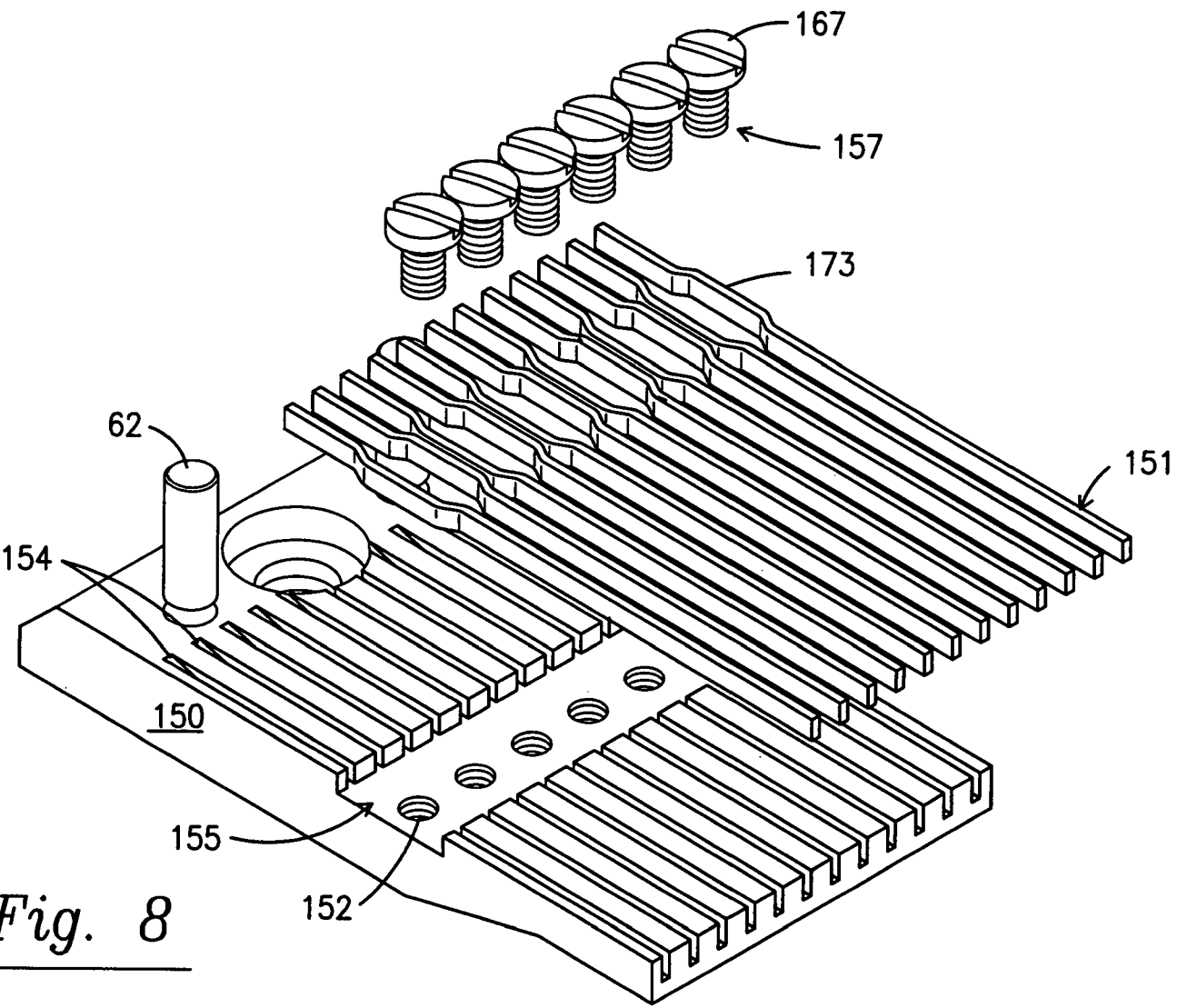
FIG. 8 is an exploded perspective view of the needle plate module of FIG. 6.
Figure 9:
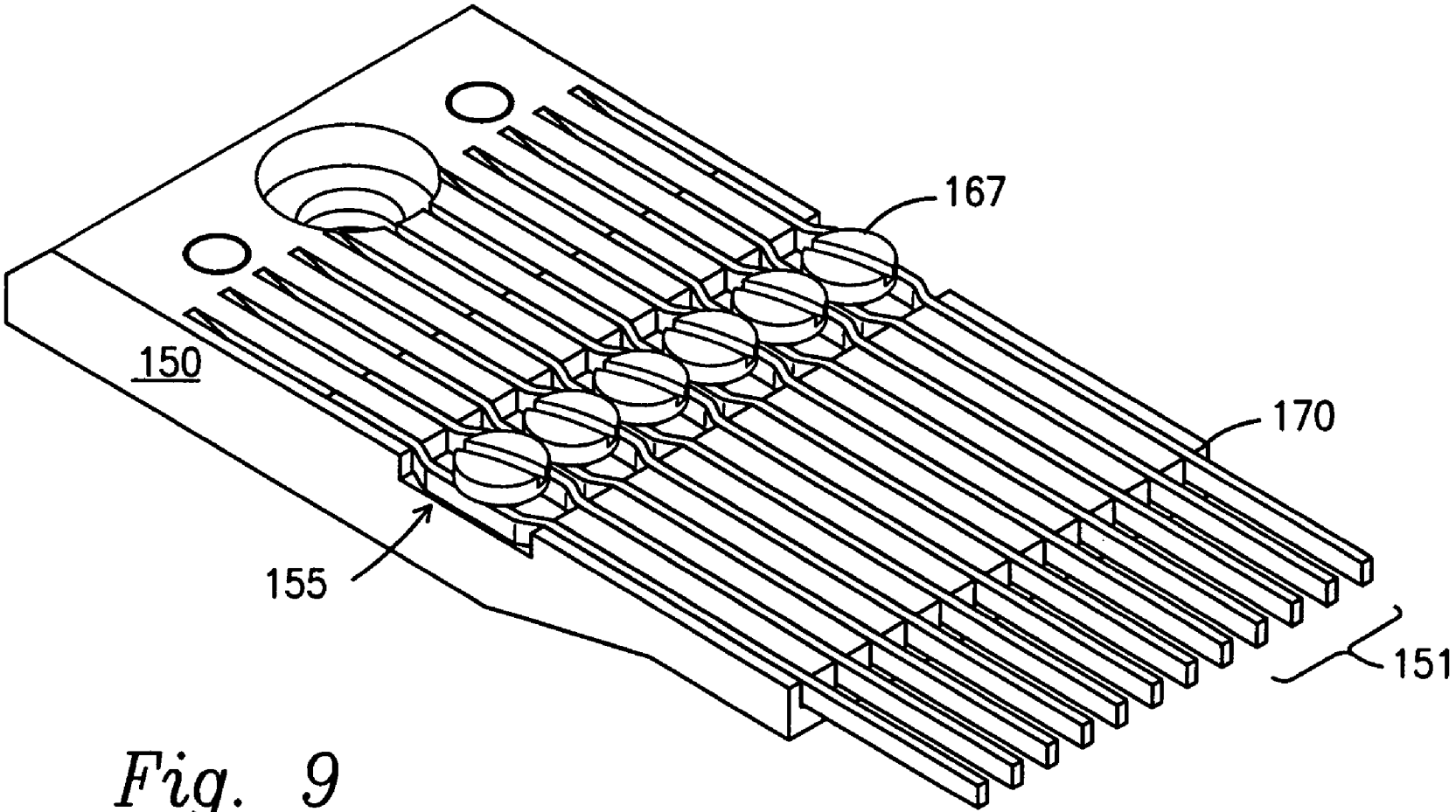
FIG. 9 is a perspective view of the needle plate module of FIG. 6.

In order to overcome these shortcomings, the new modular block 150 shown in FIG. 6 has been designed. Similar to the embodiment of FIGS. 3A through 5, the block 150 has a mounting section with pin apertures 163 and threaded apertures 153, slots 154 to receive fingers 151 and screws 157 received in apertures 152 to exert downward clamping pressure upon upper surfaces 165 of fingers 151 as those fingers 151 pass through channel 155, which generally divides or bisects slots 154. However, in order to accommodate narrower gauge spacing of fingers, at least as narrow as five-sixty fourths (5/64") inches (0.1984375 cm) utilizing size 2-56 screws intermediate their proximal ends 167 and distal ends 160, fingers 151 now have a bent section 173 as shown in FIG. 7C. At the point where the finger 151 passes through channel 155, there is a tail bend 171 in the direction away from the nearest aperture 152. Then the bent portion 173 passes alongside the aperture 152 and thereafter a head bend portion 172 returns the finger to the line of the original slot 154. Because the bent portions 173 are displaced sufficiently from the nearest aperture, it is possible to utilize the screw lock type securing mechanism for the fingers in much narrower gauge needle plate modules 150. In addition, the tail bent portion 171 acts to restrict longitudinal movement of finger 151 in the distal direction. Similarly, head bent portion 172 acts to restrict any movement of finger 151 toward the proximal end 159 of the module 150. As a result, it is not necessary to notch fingers 151 or to have a lateral slot and member as in the embodiment of FIGS. 3 through 5 to prevent longitudinal movement of fingers 151.

One further distinction is that channel 155 is cut to at least the full depth of fingers 151 in order that the bent portion 173 not be constrained by any half depth slot portion as remained, for instance, in FIG. 4 running longitudinally across shallow channel 55. As a result of the deeper channel 155, it is also desirable that the depth of slots 154 be the same depth as channel 155, rather than deeper than the shallow channel 55 in the embodiment of FIGS. 3 through 5. The result is that the upper surface 165 of fingers 151 is substantially flush with the top surface of module 150. Accordingly, at the transition between the distal end 158 of module 150, there is no change in the height at which the backing fabric 13 is supported. In the construction of FIG. 2 and as shown in FIG. 3B, at the transition point there is a slight drop in the level of support. The design of FIGS. 6 through 9 thus eliminates the need to notch fingers 151 and the need to place a lateral slot across the width of modules. The elimination of these steps results in manufacturing efficiencies.

In addition, when it is desired to utilize the screw lock type needle plate modules on a gauge greater than one-fourth inch (0.6350 cm), it is possible to reverse the bend directions 171, 172 so that rather than bending away from the adjacent aperture, the tail bend 171 is in the direction of the most adjacent aperture. In this fashion, the bent portions 173 of fingers 151 will be closer to their respective adjacent apertures rather than more distant from their respective adjacent apertures and spacing greater than one-fourth inch (0.6350 cm) may be accomplished with screws of sizes in the range of 2-56 through 8-32, which are generally acceptable for use in the tufting industry.

Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. A screw lock needle plate module for use in a tufting machine of the type reciprocating a row of transversely spaced yarn carrying needles through a base fabric to create tufts of yarn in the base fabric comprising:

a block having a top, a bottom, a pair of opposed sides and a proximal end and a distal end, a mounting section at the proximal end, a plurality of transversely spaced longitudinal slots on the top extending to the distal end of the block, and a lateral channel on the top extending between the sides and across the slots;

a plurality of fingers, each received in a longitudinal slot, and having a proximal end, an intermediate section crossing the lateral channel, and a distal end extending from the longitudinal slot beyond the distal end of the block;

wherein the intermediate sections of the plurality of fingers have a bent portion.

2. The screw lock needle plate module of claim 1 wherein the block has a plurality of threaded apertures in the lateral channel, intermediate at least some pairs of adjacent fingers.

3. The screw lock needle plate module of claim 2 wherein the bent portions of the plurality of fingers are proximate the threaded apertures.

4. The screw lock needle plate module of claim 2 further comprising a plurality of screws having heads and posts wherein the posts are received in the threaded apertures, and the heads constrain the fingers against the block.

5. The screw lock needle plate module of claim 4 wherein the plurality of screws have sizes between 2-56 and 8-32, inclusive.

6. The screw lock needle plate module of claim 1 wherein the plurality of fingers have a uniform height and the depth of the lateral channel is equal to the uniform height.

7. The screw lock needle plate module of claim 1 wherein the bent portions of the plurality of fingers have a tail bend at a distal side of the lateral channel and a head bend at a proximal side of the lateral channel.

8. The screw lock needle plate module of claim 7 wherein the tail bends of the plurality of fingers constrains distal movement of the fingers and the head bends of the plurality of fingers constrains proximal movement of the fingers.

9. The screw lock needle plate module of claim 1 wherein the mounting section comprises a threaded aperture.

10. The screw lock needle plate module of claim 1 wherein the mounting section comprises a pin aperture.

11. The screw lock needle plate module of claim 1 wherein the lateral spacing of the slots is no greater than 5/64 inches (0.1984375 cm).

12. A needle plate module having a plurality of distally extending fingers comprising:

(a) a block with a forward mounting section, a rear distal end, a top surface and a bottom;

(b) a plurality of transversely spaced slots in the top surface of the block extending to the rear distal end of the block;

(c) a laterally extending channel on the top of the block, normal to and dividing the slots into proximal and distal segments;

(d) the plurality of distally extending fingers having distal ends extending from the distal end of the block, proximal ends received in the proximal segments of the slots, intermediate sections extending across the lateral channel;

(e) a plurality of threaded apertures in the lateral channel located between adjacent alternate pairs of slots and receiving screws therein having heads that hold the fingers in place;

wherein the slots have a depth and the lateral channel has an equal depth.

13. The needle plate module of claim 12 wherein the transverse spacing of the slots is no greater than 5/64 inches (0.1984375 cm).

14. The needle plate module of claim 12 wherein the forward mounting section of the block comprises a threaded aperture and a pin aperture.

15. A needle plate module having a plurality of distally extending fingers comprising:

(a) a block with a forward mounting section, a rear distal end, a top surface and a bottom;

(b) a plurality of transversely spaced slots in the top surface of the block extending to the rear distal end of the block;

(c) a laterally extending channel on the top of the block, normal to and dividing the slots into proximal and distal segments;

(d) the plurality of distally extending fingers having distal ends extending from the distal end of the block, proximal ends received in the proximal segments of the slots, intermediate sections extending across the lateral channel;

(e) a plurality of threaded apertures in the lateral channel located between adjacent alternate pairs of slots and receiving screws therein having heads that hold the fingers in place;

wherein the intermediate sections of the plurality of fingers extending across the lateral channel have a bent portion.

16. The needle plate module of claim 12 wherein the screws received in the threaded apertures have sizes between 2-56 and 8-32 inclusive.

17. A needle plate module having a plurality of distally extending fingers comprising:

(a) a block with a forward mounting section, a rear distal end, a top surface and a bottom;

(b) a plurality of transversely spaced slots in the top surface of the block extending to the rear distal end of the block;

(c) a laterally extending channel on the top of the block, normal to and dividing the slots into proximal and distal segments;

(d) the plurality of distally extending fingers having distal ends extending from the distal end of the block, proximal ends received in the proximal segments of the slots, intermediate sections extending across the lateral channel;

(e) a plurality of threaded apertures in the lateral channel located between adjacent alternate pairs of slots and receiving screws therein having heads that hold the fingers in place;

wherein the plurality of fingers have a uniform height and the depth of the lateral channel is equal to the uniform height.

18. The needle plate module of claim 15 wherein the bent portions of the plurality of fingers are proximate the threaded apertures.

19. The needle plate module of claim 15 wherein the bent portions of the plurality of fingers have a tail bend at a distal side of the lateral channel and a head bend at a proximal side of the lateral channel.

20. The needle plate module of claim 19 wherein the tail bends of the plurality of fingers constrains distal movement of the fingers and the head bends of the plurality of fingers constrains proximal movement of the fingers.

* * * * *